US009480624B2

(12) United States Patent
Holt et al.

(10) Patent No.: US 9,480,624 B2
(45) Date of Patent: Nov. 1, 2016

(54) VIAL ADAPTER AND SYSTEM

(75) Inventors: Mark Dominis Holt, Moorpark, CA (US); Dhairya Mehta, South San Francisco, CA (US)

(73) Assignee: AMGEN INC., Thousand Oaks, CA (US)

( * ) Notice: Subject to any disclaimer, the term of this patent is extended or adjusted under 35 U.S.C. 154(b) by 391 days.

(21) Appl. No.: 13/985,103

(22) PCT Filed: Mar. 28, 2012

(86) PCT No.: PCT/US2012/030892

§ 371 (c)(1),
(2), (4) Date: Dec. 20, 2013

(87) PCT Pub. No.: WO2012/135315

PCT Pub. Date: Oct. 4, 2012

(65) Prior Publication Data

US 2014/0110370 A1 Apr. 24, 2014

Related U.S. Application Data

(60) Provisional application No. 61/470,110, filed on Mar. 31, 2011.

(51) Int. Cl.

| | |
|---|---|
| ***A61J 1/20*** | (2006.01) |
| ***A61J 1/22*** | (2006.01) |
| *A61J 1/18* | (2006.01) |

(52) U.S. Cl.

CPC .. *A61J 1/22* (2013.01); *A61J 1/20* (2013.01); *A61J 1/18* (2013.01)

(58) Field of Classification Search

CPC ..... A61J 1/20; A61J 1/2003–1/2086; F16L 21/06; F16L 21/08

See application file for complete search history.

(56) References Cited

U.S. PATENT DOCUMENTS 3,977,555 A 8/1976 Larson
4,176,756 A * 12/1979 Gellman ..... 215/274

(Continued)

FOREIGN PATENT DOCUMENTS

EP 1323403 7/2003
WO WO 95/05211 2/1995

(Continued)

OTHER PUBLICATIONS

International Search Report and Written Opinion for corresponding international application No. PCT/US2012/030892, mailing date Jun. 22, 2012.

(Continued)

*Primary Examiner* — Tatyana Zalukaeva
*Assistant Examiner* — Benjamin Klein
(74) *Attorney, Agent, or Firm* — Marshall, Gerstein & Borun LLP

(57) ABSTRACT

A vial adapter may include first and second sections each having first and second ends joined to form a collar having a central passage in which a neck of a vial may be disposed. Each collar section may have a hook formed at each end, the hooks joined to join the collar sections together. The first ends may have at least one tab depending therefrom and the second ends may have at least one indent formed therein, the tab disposed within the indent with the hooks joined to each other. In addition or instead, the collar may have an inner surface with a groove separating the collar into first and second regions on opposing axial sides of the groove. The first and second regions may be deformable axially into the groove when the collar is acted upon with the neck of the vial in the central passage.

20 Claims, 8 Drawing Sheets

(56) References Cited

U.S. PATENT DOCUMENTS

| | | | | |
|---|---|---|---|---|
| 4,372,593 | A * | 2/1983 | Kesselman | 292/307 B |
| 4,405,161 | A * | 9/1983 | Young et al. | 285/80 |
| 4,471,982 | A * | 9/1984 | Nielsen, Jr. | F16B 41/007 292/307 B |
| 4,614,437 | A | 9/1986 | Buehler | |
| 4,675,020 | A | 6/1987 | McPhee | |
| 4,759,756 | A | 7/1988 | Forman et al. | |
| 4,936,841 | A | 6/1990 | Aoki et al. | |
| 4,940,460 | A | 7/1990 | Casey et al. | |
| 5,100,394 | A | 3/1992 | Dudar et al. | |
| 5,171,214 | A | 12/1992 | Kolber et al. | |
| 5,195,992 | A | 3/1993 | Dudar et al. | |
| 5,250,037 | A | 10/1993 | Bitdinger | |
| 5,270,219 | A | 12/1993 | DeCastro et al. | |
| 5,279,576 | A | 1/1994 | Loo et al. | |
| 5,334,179 | A | 8/1994 | Poli et al. | |
| 5,429,614 | A | 7/1995 | Fowles et al. | |
| 5,445,631 | A | 8/1995 | Uchida | |
| 5,466,220 | A | 11/1995 | Brenneman | |
| 5,526,853 | A | 6/1996 | McPhee et al. | |
| 5,649,912 | A | 7/1997 | Peterson | |
| 5,893,397 | A | 4/1999 | Peterson et al. | |
| 5,957,898 | A | 9/1999 | Jepson et al. | |
| 6,071,270 | A | 6/2000 | Fowles et al. | |
| 6,090,091 | A | 7/2000 | Fowles et al. | |
| 6,120,490 | A | 9/2000 | Neftel | |
| 6,209,738 | B1 | 4/2001 | Jansen et al. | |
| 6,319,224 | B1 | 11/2001 | Stout et al. | |
| 6,358,236 | B1 | 3/2002 | DeFoggi et al. | |
| 6,474,375 | B2 | 11/2002 | Spero et al. | |
| 6,656,433 | B2 | 12/2003 | Sasso | |
| 6,666,238 | B1 * | 12/2003 | Crowley et al. | 141/286 |
| 6,755,810 | B1 | 6/2004 | Buch-Rasmussen et al. | |
| 6,875,205 | B2 | 4/2005 | Leinsing | |
| 6,890,328 | B2 | 5/2005 | Fowles et al. | |
| 7,140,401 | B2 | 11/2006 | Wilcox et al. | |
| 7,326,194 | B2 | 2/2008 | Zinger et al. | |
| 7,354,427 | B2 | 4/2008 | Fangrow | |
| 7,425,209 | B2 | 9/2008 | Fowles et al. | |
| 7,452,348 | B2 | 11/2008 | Hasegawa | |
| 7,473,246 | B2 | 1/2009 | Vancaillie et al. | |
| 8,466,793 | B2 * | 6/2013 | Kolton et al. | 340/572.8 |
| 2002/0068896 | A1 | 6/2002 | Robinson et al. | |
| 2003/0079314 | A1 | 5/2003 | Yeh | |
| 2004/0236305 | A1 | 11/2004 | Jansen et al. | |
| 2005/0148994 | A1 | 7/2005 | Leinsing | |
| 2005/0248098 | A1 * | 11/2005 | Sisk | F16L 21/06 277/616 |
| 2006/0259004 | A1 | 11/2006 | Connell et al. | |
| 2007/0060904 | A1 | 3/2007 | Vedrine et al. | |
| 2007/0062903 | A1 * | 3/2007 | Norman et al. | 215/274 |
| 2007/0088315 | A1 | 4/2007 | Haindl | |
| 2009/0036764 | A1 | 2/2009 | Rivas et al. | |
| 2009/0120934 | A1 * | 5/2009 | Domkowski | 220/253 |
| 2010/0085191 | A1 * | 4/2010 | Kolton et al. | 340/572.8 |
| 2010/0089494 | A1 | 4/2010 | Brady | |
| 2010/0253524 | A1 * | 10/2010 | Kolton et al. | 340/572.9 |
| 2011/0004187 | A1 | 1/2011 | Beiriger | |
| 2012/0067429 | A1 | 3/2012 | Mosler et al. | |
| 2013/0253432 | A1 * | 9/2013 | Avery et al. | 604/187 |
| 2014/0163468 | A1 * | 6/2014 | Avery et al. | 604/111 |

FOREIGN PATENT DOCUMENTS

| | | | |
|---|---|---|---|
| WO | WO 0239002 A1 * | 5/2002 | F16L 21/06 |
| WO | WO 02/102704 | 12/2002 | |
| WO | WO 03/082398 | 10/2003 | |
| WO | WO 2005/086587 | 9/2005 | |
| WO | WO 2006/124756 | 11/2006 | |
| WO | WO 2008/093063 | 8/2008 | |
| WO | WO 2010/096061 | 8/2010 | |

OTHER PUBLICATIONS

International Preliminary Report on Patentability corresponding international application No. PCT/US2012/030892, mailing date Oct. 1, 2013.

* cited by examiner

VIAL ADAPTER AND SYSTEM

BACKGROUND

This patent is directed to an adapter, and, in particular, to an adapter configured to facilitate connection to a vial.

Pharmaceutical products may be packaged in any of a number of different containers for storage and use. For example, the products may be pre-filled into syringes, or pre-mixed in flexible bags. These products may also be disposed in rigid-walled or semi rigid-walled containers having a stopper or valve held in place on one end by a seal or crimp ring. These containers may be referred to as vials or cartridges, although in this document they will be referred to collectively as vials.

As set forth in more detail below, the present disclosure sets forth an improved adapter embodying advantageous alternatives to conventional devices and methods.

SUMMARY

In an aspect of the present disclosure, a vial adapter may include first and second sections each having first and second ends that are joined with the opposing first and second ends of the other collar section to form a collar having a central passage in which a neck of a vial is disposed. Each of the collar sections may have a hook formed at each end of the collar section, the hooks of opposing ends of the collar sections joined to each other to join the collar sections together. The first ends of each of the collar sections may have at least one tab depending therefrom and the second ends of each of the collar sections may have at least one indent formed therein, the at least one tab disposed within the at least one indent with the hooks of opposing ends of the collar sections joined to each other.

In another aspect of the present disclosure, a vial adapter may include first and second sections each having first and second ends that are joined with the opposing first and second ends of the other collar section to form a collar having an inner surface defining a central passage in which a neck of a vial is disposed. The inner surface may have a groove formed therein, the groove separating the collar into first and second regions on opposing axial sides of the groove. The first and second regions may be deformable axially into the groove when the collar is acted upon by the vial with the neck of the vial disposed in the central passage.

BRIEF DESCRIPTION OF THE DRAWINGS

It is believed that the disclosure will be more fully understood from the following description taken in conjunction with the accompanying drawings. Some of the figures may have been simplified by the omission of selected elements for the purpose of more clearly showing other elements. Such omissions of elements in some figures are not necessarily indicative of the presence or absence of particular elements in any of the exemplary embodiments, except as may be explicitly delineated in the corresponding written description. None of the drawings are necessarily to scale.

DETAILED DESCRIPTION OF VARIOUS EMBODIMENTS

Although the following text sets forth a detailed description of different embodiments of the invention, it should be understood that the legal scope of the invention is defined by the words of the claims set forth at the end of this patent. It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

The detailed description is to be construed as exemplary only and does not describe every possible embodiment of the invention because describing every possible embodiment would be impractical, if not impossible. Numerous alternative embodiments could be implemented, using either current technology or technology developed after the filing date of this patent, which would still fall within the scope of the claims defining the invention Along these lines then, several embodiments of a vial adapter according to the present disclosure are illustrated in FIGS. 1-14.

The vial adapter illustrated in these drawings is particularly well suited to address an issue that may arise as or when a spike associated with a vial adapter is advanced into a stopper associated with a vial, the stopper disposed over a passage in a neck of the vial to control access through the passage into the vial. Specifically, under certain loading conditions, the force applied to the stopper as the spike is advanced into the stopper will cause the stopper to move relative to the vial. As the spike advances further into the vial, a crimp ring (disposed about the stopper and a rim disposed adjacent the neck of the vial to maintain the stopper fixed relative to the vial) may be unable to resist the motion of the stopper. As a consequence, the stopper may move and become lodged within the passage in the neck of the vial. This can have a negative effect on the ability of the user to access the contents of the vial.

Figure 1:
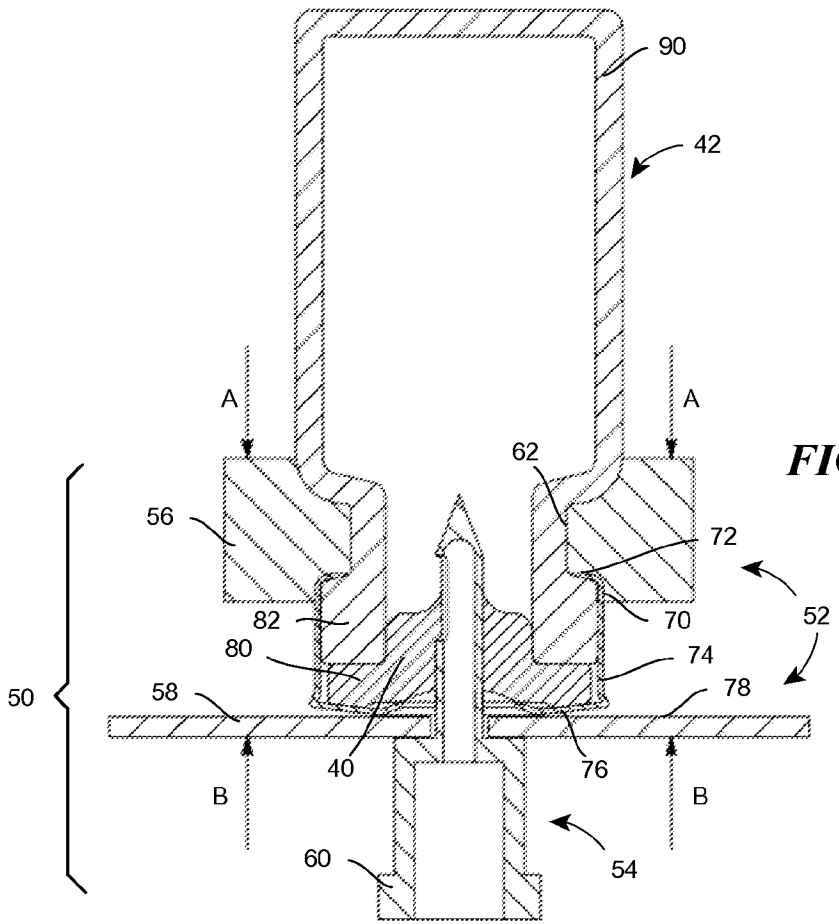
FIG. 1 is a cross-sectional view of a vial adapter to be used with a machine to facilitate retention of a stopper as a spike of the vial adapter is advanced into the stopper.

To limit the possibility of such movement of a stopper 40 relative to the remainder of a vial 42, a vial adapter 50 as illustrated in FIG. 1 may be used. According to this embodiment, the vial adapter 50 includes two subassemblies 52, 54 which may be physically separated from each other but indirectly attached to each other, through a frame or jig or a machine. The first subassembly 52 includes a collar 56. The first subassembly 52 also includes a plate 58 that will be used in conjunction with the collar 56 as explained in greater detail below. The second subassembly 54 includes a spike 60 that is intended to be advanced into the vial 42, and in particular into the stopper 40 associated with the vial 42, through a passage in the plate 58. While the second subassembly 54 may be moved manually by the user relative to the first subassembly 52, it is intended for the second subassembly 54 to be moved using a machine in an automated fashion.

The second subassembly 54, including the spike 60, and the collar 56 may be made of, for example, polymeric materials, such as plastics. Specifically, one exemplary material for the spike 60 and the collar 56 is polycarbonate, while another exemplary material for the collar 56 is polypropylene. The plate 58 may be made of metal, although it is also possible to use other materials as well.

In operation, a surface 70 of the collar 56 abuts a surface 72 of a crimp ring 74 associated with the vial 42. As illustrated, an inner surface of the collar 56 is shaped to match the contour of the crimp ring 74, as well as the contour of a shoulder of the vial 42, and thus is disposed to fill the neck 62 of the vial 42; this is an exemplary embodiment, and should not be viewed as a limiting feature of the collar 56. An opposite surface 76 of the crimp ring 74 abuts a surface 78 of the plate 58. A force (represented by arrow A) is applied in a first direction to the collar 56, while an opposing force (represented by arrow B) is applied in the opposite direction to or by the plate 58. That is, it will be understood that the opposing force represented by arrow B may simply be a reactive force to the force represented by arrow A or may be a separate force applied to the plate 58; it will also be recognized that the force could be applied to the plate 58 with the collar 56 held fixed, such that the force represented by arrow A may be a reactive force instead. These forces are transmitted by the collar 56 and the plate 58 to the crimp ring 74, and from the crimp ring 74 to a section 80 of the stopper 40 and an enlarged rim 82 of the vial 42 disposed adjacent the neck 62. It is believed that the application of forces in this fashion will limit the movement of the stopper 40 relative to the vial 42 as the spike 60 advances into the vial 42 through the stopper 40.

It should be noted that the application of forces in this fashion has a decided advantage over application of the forces to the plate 58 and an opposing end 90 of the vial 42. With the forces applied as shown, with the collar 56 transmitting force in the region of the stopper 40, crimp ring 74, and rim 82, the forces are applied to a relatively thick section of the glass container that defines, in part, the vial 42. Consequently, it is believed that the rim 82 will be more resistant to breakage than the relatively thinner wall that defines the second end 90 of the vial 42. In fact, it is believed that if imperfections are formed in the wall of the container during fabrication, loading the forces at opposing ends of the vial 42 is more likely to result in failure than if the loading occurs in the relatively thicker region of the rim 82. Consequently, it is believed that the vial adapter 50 has significant advantages over existing technology in regard to providing suitable forces to oppose movement of the stopper 40 relative to the remainder of the vial 42 while limiting the chances for failure of the vial 42 under such loading.

In regard to various different embodiments of the system just described, the vial 42 may contain a pharmaceutical product, such as an erythropoiesis stimulating agent (ESA), which may be in a liquid or a lyophilized form. An ESA is any molecule that stimulates erythropoiesis, such as Epogen® (Epoetin alfa), Aranesp® (Darbepoetin alfa), Dynepo (Epoetin delta), Mircera (methyoxy polyethylene glycol-epoetin beta), Hematide, MRK-2578, INS-22, Retacrit (Epoetin zeta), Neorecormon (Epoetin beta), Silapo (Epoetin zeta), Binocrit (Epoetin alfa), Epoetin alfa Hexal, Abseamed (Epoetin alfa), Ratioepo (Epoetin theta), Eporatio (Epoetin theta), Biopoin (Epoetin theta), Epoetin alfa, Epoetin beta, Epoetin Zeta, Epoetin Theta, and Epoetin delta, as well as the molecules or variants or analogs thereof as disclosed in the following patents or patent applications, which are each herein incorporated by reference in its entirety: U.S. Pat. Nos. 4,703,008; 5,441,868; 5,547,933; 5,618,698; 5,621,080; 5,756,349; 5,767,078; 5,773,569; 5,955,422; 5,986,047; 6,583,272; 7,084,245; and 7,271,689; and PCT Publ. Nos. WO 91/05867; WO 95/05465; WO 96/40772; WO 00/24893; WO 01/81405; and WO 2007/136752.

An ESA can be an erythropoiesis stimulating protein. As used herein, "erythropoiesis stimulating protein" means any protein that directly or indirectly causes activation of the erythropoietin receptor, for example, by binding to and causing dimerization of the receptor. Erythropoiesis stimulating proteins include erythropoietin and variants, analogs, or derivatives thereof that bind to and activate erythropoietin receptor; antibodies that bind to erythropoietin receptor and activate the receptor; or peptides that bind to and activate erythropoietin receptor. Erythropoiesis stimulating proteins include, but are not limited to, epoetin alfa, epoetin beta, epoetin delta, epoetin omega, epoetin iota, epoetin zeta, and analogs thereof, pegylated erythropoietin, carbamylated erythropoietin, mimetic peptides (including EMP1/hematide), and mimetic antibodies. Exemplary erythropoiesis stimulating proteins include erythropoietin, darbepoetin, erythropoietin agonist variants, and peptides or antibodies that bind and activate erythropoietin receptor (and include compounds reported in U.S. Publ. Nos. 2003/0215444 and 2006/0040858, the disclosures of each of which is incorporated herein by reference in its entirety) as well as erythropoietin molecules or variants or analogs thereof as disclosed in the following patents or patent applications, which are each herein incorporated by reference in its entirety: U.S. Pat. Nos. 4,703,008; 5,441,868; 5,547,933; 5,618,698; 5,621,080; 5,756,349; 5,767,078; 5,773,569; 5,955,422; 5,830,851; 5,856,298; 5,986,047; 6,030,086; 6,310,078; 6,391,633; 6,583,272; 6,586,398; 6,900,292; 6,750,369; 7,030,226; 7,084,245; and 7,217,689; US Publ. Nos. 2002/0155998; 2003/0077753; 2003/0082749; 2003/0143202; 2004/0009902; 2004/0071694; 2004/0091961; 2004/0143857; 2004/0157293; 2004/0175379; 2004/0175824; 2004/0229318; 2004/0248815; 2004/0266690; 2005/

0019914; 2005/0026834; 2005/0096461; 2005/0107297; 2005/0107591; 2005/0124045; 2005/0124564; 2005/0137329; 2005/0142642; 2005/0143292; 2005/0153879; 2005/0158822; 2005/0158832; 2005/0170457; 2005/0181359; 2005/0181482; 2005/0192211; 2005/0202538; 2005/0227289; 2005/0244409; 2006/0088906; and 2006/0111279; and PCT Publ. Nos. WO 91/05867; WO 95/05465; WO 99/66054; WO 00/24893; WO 01/81405; WO 00/61637; WO 01/36489; WO 02/014356; WO 02/19963; WO 02/20034; WO 02/49673; WO 02/085940; WO 03/029291; WO 2003/055526; WO 2003/084477; WO 2003/094858; WO 2004/002417; WO 2004/002424; WO 2004/009627; WO 2004/024761; WO 2004/033651; WO 2004/035603; WO 2004/043382; WO 2004/101600; WO 2004/101606; WO 2004/101611; WO 2004/106373; WO 2004/018667; WO 2005/001025; WO 2005/001136; WO 2005/021579; WO 2005/025606; WO 2005/032460; WO 2005/051327; WO 2005/063808; WO 2005/063809; WO 2005/070451; WO 2005/081687; WO 2005/084711; WO 2005/103076; WO 2005/100403; WO 2005/092369; WO 2006/50959; WO 2006/02646; and WO 2006/29094.

Alternatively, the vial 42 may contain other products. Examples of other pharmaceutical products that may be contained in the vial 42 may include, but are not limited to, therapeutics such as a biological (e.g., Enbrel® (etanercept, TNF-receptor/Fc fusion protein, TNF blocker), Neulasta® (Pegylated filgastrim, pegylated G-CSF, pegylated hu-Met-G-CSF), Neupogen® (Filgrastim, G-CSF, hu-MetG-CSF), Nplate® (Romiplostim), Vectibix® (Panitumumab), Sensipar® (Cinacalcet), and Denosamab® (AMG 162)), a small molecule drug, a therapeutic antibody, a polypeptide, a protein or other chemical, such as an iron, for example, ferumoxytol, iron dextrans, ferric glyconate, and iron sucrose. The therapeutic may be in liquid form, or reconstituted from lyophilized form.

Among particular illustrative proteins are the specific proteins set forth below, including fusions, fragments, analogs, variants or derivatives thereof:

OPGL specific antibodies, peptibodies, and related proteins, and the like (also referred to as RANKL specific antibodies, peptibodies and the like), including fully humanized and human OPGL specific antibodies, particularly fully humanized monoclonal antibodies, including but not limited to the antibodies described in PCT Publ. No. WO 03/002713, which is incorporated herein in its entirety as to OPGL specific antibodies and antibody related proteins, particularly those having the sequences set forth therein, particularly, but not limited to, those denoted therein: 9H7; 18B2; 2D8; 2E11; 16E1; and 22B3, including the OPGL specific antibodies having either the light chain of SEQ ID NO: 2 as set forth therein in FIG. 2 and/or the heavy chain of SEQ ID NO:4, as set forth therein in FIG. 4, each of which is individually and specifically incorporated by reference herein in its entirety fully as disclosed in the foregoing Publication;

Myostatin binding proteins, peptibodies, and related proteins, and the like, including myostatin specific peptibodies, particularly those described in US Publ. No. 2004/0181033 and PCT Publ. No. WO 2004/058988, which are incorporated by reference herein in their entirety particularly in parts pertinent to myostatin specific peptibodies, including but not limited to peptibodies of the mTN8-19 family, including those of SEQ ID NOS: 305-351, including TN8-19-1 through TN8-19-40, TN8-19 con1 and TN8-19 con2; peptibodies of the mL2 family of SEQ ID NOS: 357-383; the mL15 family of SEQ ID NOS: 384-409; the mL17 family of SEQ ID NOS: 410-438; the mL20 family of SEQ ID NOS: 439-446; the mL21 family of SEQ ID NOS: 447-452; the mL24 family of SEQ ID NOS: 453-454; and those of SEQ ID NOS: 615-631, each of which is individually and specifically incorporated by reference herein in their entirety fully as disclosed in the foregoing publication;

IL-4 receptor specific antibodies, peptibodies, and related proteins, and the like, particularly those that inhibit activities mediated by binding of IL-4 and/or IL-13 to the receptor, including those described in PCT Publ. No. WO 2005/047331 or PCT Appl. No. PCT/US2004/03742 and in US Publ. No. 2005/112694, which are incorporated herein by reference in there entirety particularly in parts pertinent to IL-4 receptor specific antibodies, particularly such antibodies as are described therein, particularly, and without limitation, those designated therein: L1H1; L1H2; L1H3; L1H4; L1H5; L1H6; L1H7; L1H8; L1H9; L1H10; L1H11; L2H1; L2H2; L2H3; L2H4; L2H5; L2H6; L2H7; L2H8; L2H9; L2H10; L2H11; L2H12; L2H13; L2H14; L3H1; L4H1; L5H1; L6H1, each of which is individually and specifically incorporated by reference herein in its entirety fully as disclosed in the foregoing publication;

Interleukin 1-receptor 1 ("IL1-R1") specific antibodies, peptibodies, and related proteins, and the like, including but not limited to those described in U.S. Publ. No. 2004/097712A1, which is incorporated herein by reference in its entirety in parts pertinent to IL1-R1 specific binding proteins, monoclonal antibodies in particular, especially, without limitation, those designated therein: 15CA, 26F5, 27F2, 24E12, and 10H7, each of which is individually and specifically incorporated by reference herein in its entirety fully as disclosed in the aforementioned U.S. publication;

Ang2 specific antibodies, peptibodies, and related proteins, and the like, including but not limited to those described in PCT Publ. No. WO 03/057134 and U.S. Publ No. 2003/0229023, each of which is incorporated herein by reference in its entirety particularly in parts pertinent to Ang2 specific antibodies and peptibodies and the like, especially those of sequences described therein and including but not limited to: L1(N); L1(N) WT; L1(N) 1K WT; 2xL1(N); 2xL1(N) WT; Con4 (N), Con4 (N) 1K WT, 2xCon4 (N) 1K; L1C; L1C 1K; 2xL1C; Con4C; Con4C 1K; 2xCon4C 1K; Con4-L1 (N); Con4-L1C; TN-12-9 (N); C17 (N); TN8-8(N); TN8-14 (N); Con 1 (N), also including anti-Ang 2 antibodies and formulations such as those described in PCT Publ. No. WO 2003/030833 which is incorporated herein by reference in its entirety as to the same, particularly Ab526; Ab528; Ab531; Ab533; Ab535; Ab536; Ab537; Ab540; Ab543; Ab544; Ab545; Ab546; A551; Ab553; Ab555; Ab558; Ab559; Ab565; AbF1AbFD; AbFE; AbFJ; AbFK; AbG1D4; AbGC1E8; AbH1C12; AblA1; AblF; AblK, AblP; and AblP, in their various permutations as described therein, each of which is individually and specifically incorporated by reference herein in its entirety fully as disclosed in the foregoing publication;

NGF specific antibodies, peptibodies, and related proteins, and the like including, in particular, but not limited to those described in US Publ. No. 2005/0074821 and U.S. Pat. No. 6,919,426, which are incorporated herein by reference in their entirety particularly as to NGF-specific antibodies and related proteins in this regard, including in particular, but not limited to, the NGF-specific antibodies therein designated 4D4, 4G6, 6H9, 7H2, 14D10 and 14D11, each of which is individually and specifically incorporated by reference herein in its entirety fully as disclosed in the foregoing publication;

CD22 specific antibodies, peptibodies, and related proteins, and the like, such as those described in U.S. Pat. No.

5,789,554, which is incorporated herein by reference in its entirety as to CD22 specific antibodies and related proteins, particularly human CD22 specific antibodies, such as but not limited to humanized and fully human antibodies, including but not limited to humanized and fully human monoclonal antibodies, particularly including but not limited to human CD22 specific IgG antibodies, such as, for instance, a dimer of a human-mouse monoclonal hLL2 gamma-chain disulfide linked to a human-mouse monoclonal hLL2 kappa-chain, including, but limited to, for example, the human CD22 specific fully humanized antibody in Epratuzumab, CAS registry number 501423-23-0;

IGF-1 receptor specific antibodies, peptibodies, and related proteins, and the like, such as those described in PCT Publ. No. WO 06/069202, which is incorporated herein by reference in its entirety as to IGF-1 receptor specific antibodies and related proteins, including but not limited to the IGF-1 specific antibodies therein designated L1H1, L2H2, L3H3, L4H4, L5H5, L6H6, L7H7, L8H8, L9H9, L10H10, L11H11, L12H12, L13H13, L14H14, L15H15, L16H16, L17H17, L18H18, L19H19, L20H20, L21H21, L22H22, L23H23, L24H24, L25H25, L26H26, L27H27, L28H28, L29H29, L30H30, L31H31, L32H32, L33H33, L34H34, L35H35, L36H36, L37H37, L38H38, L39H39, L40H40, L41H41, L42H42, L43H43, L44H44, L45H45, L46H46, L47H47, L48H48, L49H49, L50H50, L51H51, L52H52, and IGF-1R-binding fragments and derivatives thereof, each of which is individually and specifically incorporated by reference herein in its entirety fully as disclosed in the foregoing International Publication;

Also among non-limiting examples of anti-IGF-1R antibodies for use in the methods and compositions of the present invention are each and all of those described in:

(i) US Publ. No. 2006/0040358 (published Feb. 23, 2006), 2005/0008642 (published Jan. 13, 2005), 2004/0228859 (published Nov. 18, 2004), including but not limited to, for instance, antibody 1A (DSMZ Deposit No. DSM ACC 2586), antibody 8 (DSMZ Deposit No. DSM ACC 2589), antibody 23 (DSMZ Deposit No. DSM ACC 2588) and antibody 18 as described therein;

(ii) PCT Publ. No. WO 06/138729 (published Dec. 28, 2006) and WO 05/016970 (published Feb. 24, 2005), and Lu et al., 2004, J Biol. Chem. 279:2856-65, including but not limited to antibodies 2F8, A12, and IMC-A12 as described therein;

(iii) PCT Publ. No. WO 07/012,614 (published Feb. 1, 2007), WO 07/000,328 (published Jan. 4, 2007), WO 06/013472 (published Feb. 9, 2006), WO 05/058967 (published Jun. 30, 2005), and WO 03/059951 (published Jul. 24, 2003);

(iv) US Publ. No. 2005/0084906 (published Apr. 21, 2005), including but not limited to antibody 7C10, chimaeric antibody C7C10, antibody h7C10, antibody 7H2M, chimaeric antibody *7C10, antibody GM 607, humanized antibody 7C10 version 1, humanized antibody 7C10 version 2, humanized antibody 7C10 version 3, and antibody 7H2HM, as described therein;

(v) US Publ. Nos. 2005/0249728 (published Nov. 10, 2005), 2005/0186203 (published Aug. 25, 2005), 2004/0265307 (published Dec. 30, 2004), and 2003/0235582 (published Dec. 25, 2003) and Maloney et al., 2003, Cancer Res. 63:5073-83, including but not limited to antibody EM164, resurfaced EM164, humanized EM164, huEM164 v1.0, huEM164 v1.1, huEM164 v1.2, and huEM164 v1.3 as described therein;

(vi) U.S. Pat. No. 7,037,498 (issued May 2, 2006), US Publ. Nos. 2005/0244408 (published Nov. 30, 2005) and 2004/0086503 (published May 6, 2004), and Cohen, et al., 2005, Clinical Cancer Res. 11:2063-73, e.g., antibody CP-751, 871, including but not limited to each of the antibodies produced by the hybridomas having the ATCC accession numbers PTA-2792, PTA-2788, PTA-2790, PTA-2791, PTA-2789, PTA-2793, and antibodies 2.12.1, 2.13.2, 2.14.3, 3.1.1, 4.9.2, and 4.17.3, as described therein;

(vii) US Publ. Nos. 2005/0136063 (published Jun. 23, 2005) and 2004/0018191 (published Jan. 29, 2004), including but not limited to antibody 19D12 and an antibody comprising a heavy chain encoded by a polynucleotide in plasmid 15H12/19D12 HCA (γ4), deposited at the ATCC under number PTA-5214, and a light chain encoded by a polynucleotide in plasmid 15H12/19D12 LCF (κ), deposited at the ATCC under number PTA-5220, as described therein; and (viii) US Publ. No. 2004/0202655 (published Oct. 14, 2004), including but not limited to antibodies PINT-6A1, PINT-7A2, PINT-7A4, PINT-7A5, PINT-7A6, PINT-8A1, PINT-9A2, PINT-11A1, PINT-11A2, PINT-11A3, PINT-11A4, PINT-11A5, PINT-11A7, PINT-11A12, PINT-12A1, PINT-12A2, PINT-12A3, PINT-12A4, and PINT-12A5, as described therein; each and all of which are herein incorporated by reference in their entireties, particularly as to the aforementioned antibodies, peptibodies, and related proteins and the like that target IGF-1 receptors;

B-7 related protein 1 specific antibodies, peptibodies, related proteins and the like ("B7RP-1," also is referred to in the literature as B7H2, ICOSL, B7h, and CD275), particularly B7RP-specific fully human monoclonal IgG2 antibodies, particularly fully human IgG2 monoclonal antibody that binds an epitope in the first immunoglobulin-like domain of B7RP-1, especially those that inhibit the interaction of B7RP-1 with its natural receptor, ICOS, on activated T cells in particular, especially, in all of the foregoing regards, those disclosed in U.S. Publ. No. 2008/0166352 and PCT Publ. No. WO 07/011,941, which are incorporated herein by reference in their entireties as to such antibodies and related proteins, including but not limited to antibodies designated therein as follow: 16H (having light chain variable and heavy chain variable sequences SEQ ID NO:1 and SEQ ID NO:7 respectively therein); 5D (having light chain variable and heavy chain variable sequences SEQ ID NO:2 and SEQ ID NO:9 respectively therein); 2H (having light chain variable and heavy chain variable sequences SEQ ID NO:3 and SEQ ID NO:10 respectively therein); 43H (having light chain variable and heavy chain variable sequences SEQ ID NO:6 and SEQ ID NO:14 respectively therein); 41H (having light chain variable and heavy chain variable sequences SEQ ID NO:5 and SEQ ID NO:13 respectively therein); and 15H (having light chain variable and heavy chain variable sequences SEQ ID NO:4 and SEQ ID NO:12 respectively therein), each of which is individually and specifically incorporated by reference herein in its entirety fully as disclosed in the foregoing U.S. Publication;

IL-15 specific antibodies, peptibodies, and related proteins, and the like, such as, in particular, humanized monoclonal antibodies, particularly antibodies such as those disclosed in U.S. Publ. Nos. 2003/0138421; 2003/023586; and 2004/0071702; and U.S. Pat. No. 7,153,507, each of which is incorporated herein by reference in its entirety as to IL-15 specific antibodies and related proteins, including peptibodies, including particularly, for instance, but not limited to, HuMax IL-15 antibodies and related proteins, such as, for instance, 146B7;

IFN gamma specific antibodies, peptibodies, and related proteins and the like, especially human IFN gamma specific antibodies, particularly fully human anti-IFN gamma antibodies, such as, for instance, those described in US Publ. No. 2005/0004353, which is incorporated herein by reference in its entirety as to IFN gamma specific antibodies, particularly, for example, the antibodies therein designated 1118; 1118*; 1119; 1121; and 1121*. The entire sequences of the heavy and light chains of each of these antibodies, as well as the sequences of their heavy and light chain variable regions and complementarity determining regions, are each individually and specifically incorporated by reference herein in its entirety fully as disclosed in the foregoing US Publication and in Thakur et al., Mol. Immunol. 36:1107-1115 (1999). In addition, description of the properties of these antibodies provided in the foregoing US publication is also incorporated by reference herein in its entirety. Specific antibodies include those having the heavy chain of SEQ ID NO: 17 and the light chain of SEQ ID NO:18; those having the heavy chain variable region of SEQ ID NO:6 and the light chain variable region of SEQ ID NO:8; those having the heavy chain of SEQ ID NO:19 and the light chain of SEQ ID NO:20; those having the heavy chain variable region of SEQ ID NO:10 and the light chain variable region of SEQ ID NO:12; those having the heavy chain of SEQ ID NO:32 and the light chain of SEQ ID NO:20; those having the heavy chain variable region of SEQ ID NO:30 and the light chain variable region of SEQ ID NO:12; those having the heavy chain sequence of SEQ ID NO:21 and the light chain sequence of SEQ ID NO:22; those having the heavy chain variable region of SEQ ID NO:14 and the light chain variable region of SEQ ID NO:16; those having the heavy chain of SEQ ID NO:21 and the light chain of SEQ ID NO:33; and those having the heavy chain variable region of SEQ ID NO:14 and the light chain variable region of SEQ ID NO:31, as disclosed in the foregoing US Publication. A specific antibody contemplated is antibody 1119 as disclosed in foregoing US Publication and having a complete heavy chain of SEQ ID NO:17 as disclosed therein and having a complete light chain of SEQ ID NO:18 as disclosed therein;

TALL-1 specific antibodies, peptibodies, and the related proteins, and the like, and other TALL specific binding proteins, such as those described in U.S. Publ. Nos. 2003/0195156 and 2006/0135431, each of which is incorporated herein by reference in its entirety as to TALL-1 binding proteins, particularly the molecules of Tables 4 and 5B, each of which is individually and specifically incorporated by reference herein in its entirety fully as disclosed in the foregoing US Publications;

Parathyroid hormone ("PTH") specific antibodies, peptibodies, and related proteins, and the like, such as those described in U.S. Pat. No. 6,756,480, which is incorporated herein by reference in its entirety, particularly in parts pertinent to proteins that bind PTH;

Thrombopoietin receptor ("TPO-R") specific antibodies, peptibodies, and related proteins, and the like, such as those described in U.S. Pat. No. 6,835,809, which is herein incorporated by reference in its entirety, particularly in parts pertinent to proteins that bind TPO-R;

Hepatocyte growth factor ("HGF") specific antibodies, peptibodies, and related proteins, and the like, including those that target the HGF/SF:cMet axis (HGF/SF:c-Met), such as the fully human monoclonal antibodies that neutralize hepatocyte growth factor/scatter (HGF/SF) described in US Publ. No. 2005/0118643 and PCT Publ. No. WO 2005/017107, huL2G7 described in U.S. Pat. No. 7,220,410 and OA-5d5 described in U.S. Pat. Nos. 5,686,292 and 6,468,529 and in PCT Publ. No. WO 96/38557, each of which is incorporated herein by reference in its entirety, particularly in parts pertinent to proteins that bind HGF;

TRAIL-R2 specific antibodies, peptibodies, related proteins and the like, such as those described in U.S. Pat. No. 7,521,048, which is herein incorporated by reference in its entirety, particularly in parts pertinent to proteins that bind TRAIL-R2;

Activin A specific antibodies, peptibodies, related proteins, and the like, including but not limited to those described in US Publ. No. 2009/0234106, which is herein incorporated by reference in its entirety, particularly in parts pertinent to proteins that bind Activin A;

TGF-beta specific antibodies, peptibodies, related proteins, and the like, including but not limited to those described in U.S. Pat. No. 6,803,453 and US Publ. No. 2007/0110747, each of which is herein incorporated by reference in its entirety, particularly in parts pertinent to proteins that bind TGF-beta;

Amyloid-beta protein specific antibodies, peptibodies, related proteins, and the like, including but not limited to those described in PCT Publ. No. WO 2006/081171, which is herein incorporated by reference in its entirety, particularly in parts pertinent to proteins that bind amyloid-beta proteins. One antibody contemplated is an antibody having a heavy chain variable region comprising SEQ ID NO: 8 and a light chain variable region having SEQ ID NO: 6 as disclosed in the International Publication;

c-Kit specific antibodies, peptibodies, related proteins, and the like, including but not limited to those described in Publ. No. 2007/0253951, which is incorporated herein by reference in its entirety, particularly in parts pertinent to proteins that bind c-Kit and/or other stem cell factor receptors;

OX40L specific antibodies, peptibodies, related proteins, and the like, including but not limited to those described in U.S. application Ser. No. 11/068,289, which is incorporated herein by reference in its entirety, particularly in parts pertinent to proteins that bind OX40L and/or other ligands of the OX040 receptor; and Other exemplary proteins, including Activase® (Alteplase, tPA); Aranesp® (Darbepoetin alfa), Epogen® (Epoetin alfa, or erythropoietin); Avonex® (Interferon beta-1a); Bexxar® (Tositumomab, anti-CD22 monoclonal antibody); Betaseron® (Interferon-beta); Campath® (Alemtuzumab, anti-CD52 monoclonal antibody); Dynepo® (Epoetin delta); Velcade® (bortezomib); MLN0002 (anti-α4137 mAb); MLN1202 (anti-CCR2 chemokine receptor mAb); Enbrel® (etanercept, TNF-receptor/Fc fusion protein, TNF blocker); Eprex® (Epoetin alfa); Erbitux® (Cetuximab, anti-EGFR/HER1/c-ErbB-1); Genotropin® (Somatropin, Human Growth Hormone); Herceptin® (Trastuzumab, anti-HER2/neu (erbB2) receptor mAb); Humatrope® (Somatropin, Human Growth Hormone); Humira® (Adalimumab); Insulin in Solution; Infergen® (Interferon Alfacon-1); Natrecor® (nesiritide; recombinant human B-type natriuretic peptide (hBNP); Kineret® (Anakinra), Leukine® (Sargamostim, rhuGM-CSF); LymphoCide® (Epratuzumab, anti-CD22 mAb); Lymphostat B® (Belimumab, anti-BlyS mAb); Metalyse® (Tenecteplase, t-PA analog); Mircera® (methoxy polyethylene glycol-epoetin beta); Mylotarg® (Gemtuzumab ozogamicin); Raptiva® (efalizumab); Cimzia® (certolizumab pegol, CDP 870); Soliris™ (Eculizumab); Pexelizumab (Anti-C5 Complement); MEDI-524 (Numax®); Lucentis® (Ranibizumab); 17-1A (Edrecolomab, Panorex®); Trabio® (lerdelimumab); TheraCim hR3 (Nimotuzumab); Omnitarg (Pertuzumab, 2C4); Osidem® (IDM-1); OvaRex® (B43.13); Nuvion® (visilizumab); Cantuzumab mertansine (huC242-DM1); NeoRecormon® (Epoetin beta); Neumega® (Oprelvekin, Human Interleukin-11); Neulasta® (Pegylated filgastrim, pegylated G-CSF, pegylated hu-Met-G-CSF); Neupogen® (Filgrastim, G-CSF, hu-MetG-CSF); Orthoclone OKT3® (Muromonab-CD3, anti-CD3 monoclonal antibody), Procrit® (Epoetin alfa); Remicade® (Infliximab, anti-TNFα monoclonal antibody), Reopro® (Abciximab, anti-GP 1Ib/Ilia receptor monoclonal antibody), Actemra® (anti-IL6 Receptor mAb), Avastin® (Bevacizumab), HuMax-CD4 (zanolimumab), Rituxan® (Rituximab, anti-CD20 mAb); Tarceva® (Erlotinib); Roferon-A®-(Interferon alfa-2a); Simulect® (Basiliximab); Prexige® (lumiracoxib); Synagis® (Palivizumab); 146B7-CHO (anti-IL15 antibody, see U.S. Pat. No. 7,153,507), Tysabri® (Natalizumab, anti-α4integrin mAb); Valortim® (MDX-1303, anti-B. anthracis Protective Antigen mAb); ABthrax™; Vectibix® (Panitumumab); Xolair® (Omalizumab), ETI211 (anti-MRSA mAb), IL-1 Trap (the Fc portion of human IgG1 and the extracellular domains of both IL-1 receptor components (the Type I receptor and receptor accessory protein)), VEGF Trap (Ig domains of VEGFR1 fused to IgG1 Fc), Zenapax® (Daclizumab); Zenapax® (Daclizumab, anti-IL-2Rα mAb), Zevalin® (Ibritumomab tiuxetan), Zetia (ezetimibe), Atacicept (TACI-Ig), anti-CD80 monoclonal antibody (mAb) (galiximab), anti-CD23 mAb (lumiliximab), BR2-Fc (huBR3/huFc fusion protein, soluble BAFF antagonist); CNTO 148 (Golimumab, anti-TNFα mAb); HGS-ETR1 (Mapatumumab; human anti-TRAIL Receptor-1 mAb); HuMax-CD20 (Ocrelizumab, anti-CD20 human mAb); HuMax-EGFR (zalutumumab); M200 (Volociximab, anti-α5β1 integrin mAb); MDX-010 (Ipilimumab, anti-CTLA-4 mAb and VEGFR-1 (IMC-18F1); anti-BR3 mAb; anti-C. difficile Toxin A and Toxin B C mAbs MDX-066 (CDA-1) and MDX-1388); anti-CD22 dsFv-PE38 conjugates (CAT-3888 and CAT-8015); anti-CD25 mAb (HuMax-TAC); anti-CD3 mAb (NI-0401); Adecatumumab; anti-CD30 mAb (MDX-060); MDX-1333 (anti-IFNAR); anti-CD38 mAb (HuMax CD38); anti-CD40L mAb; anti-Cripto mAb; anti-CTGF Idiopathic Pulmonary Fibrosis Phase I Fibrogen (FG-3019); anti-CTLA4 mAb; anti-eotaxinl mAb (CAT-213); anti-FGF8 mAb; anti-ganglioside GD2 mAb; anti-ganglioside GM2 mAb; anti-GDF-8 human mAb (MYO-029); anti-GM-CSF Receptor mAb (CAM-3001); anti-HepC mAb (HuMax HepC); anti-IFNα mAb (MEDI-545, MDX-1103); anti-IGF1R mAb; anti-IGF-1R mAb (HuMax-Inflam); anti-IL12 mAb (ABT-874); anti-IL12/IL23 mAb (CNTO 1275); anti-IL13 mAb (CAT-354); anti-IL2Ra mAb (HuMax-TAC); anti-IL5 Receptor mAb; anti-integrin receptors mAb (MDX-018, CNTO 95); anti-IP10 Ulcerative Colitis mAb (MDX-1100); anti-LLY antibody; BMS-66513; anti-Mannose Receptor/hCGβ mAb (MDX-1307); anti-mesothelin dsFv-PE38 conjugate (CAT-5001); anti-PD1 mAb (MDX-1106 (ONO-4538)); anti-PDGFRα antibody (IMC-3G3); anti-TGFβ mAb (GC-1008); anti-TRAIL Receptor-2 human mAb (HGS-ETR2); anti-TWEAK mAb; anti-VEGFR/Flt-1 mAb; anti-ZP3 mAb (HuMax-ZP3); NVS Antibody #1; and NVS Antibody #2.

As to the vial adapter 50 of such a system, and in particular the collar 56, there may also be considerable variation in structure and assembly.

Figure 2:
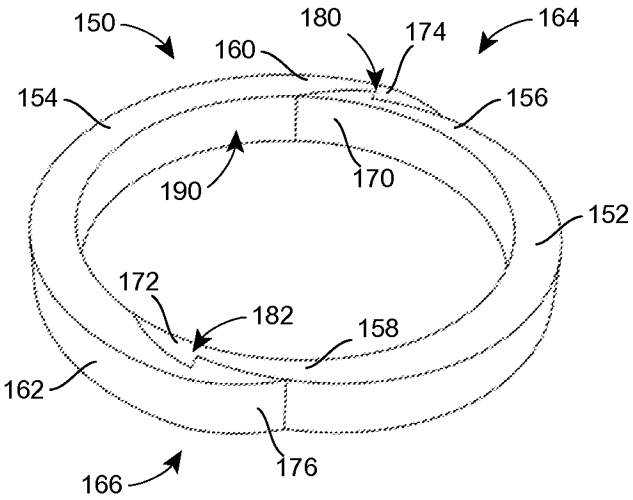
FIG. 2 is a perspective view of a collar for use with the system of FIG. 1.

For instance, FIG. 2 illustrates an embodiment of the collar 56 which may be used in conjunction with the vial 42 and the other aspects of the vial adapter 50. Specifically, the collar, referenced generally as 150, may include first and second sections 152, 154, which may be C-shaped or arcuate as illustrated. The first section 152 has ends 156, 158, while the second section 154 has opposing ends 160, 162. The sections 152, 154 are secured or joined at opposing ends 156, 158, 160, 162 by one or more fasteners or pairs of fasteners 164, 166 to form the collar 150 (an annular collar, as illustrated) having a central passage in which the neck 62 of the vial 42 is disposed.

In the particular embodiment illustrated, the fasteners 164, 166 may be in the form of interlocking or mating hooks 170, 172, 174, 176. The hooks 170, 172 are disposed at the ends 156, 158 of the first C-shaped section (or arc) 152, and the hooks 174, 176 are disposed at the ends 160, 162 of the second C-shaped section (or arc) 154. Also, as illustrated, the hooks 170, 172 may be disposed radially inwardly of the hooks 174, 176. The hooks 170, 172, 174, 176 may be joined, for example with opposed surfaces of the hooks (at 180, 182) abutting each other, to limit or prevent separation of the two C-shaped sections 152, 154 from each other (i.e., to join the sections 152, 154 together) when the collar 150 is disposed in the neck 62 of the vial 42. While not illustrated as such, an inner surface 190 of the collar 150 may conform to the neck 62 of the vial 42 in the same fashion as the collar 56 illustrated in FIG. 1.

Figure 4:
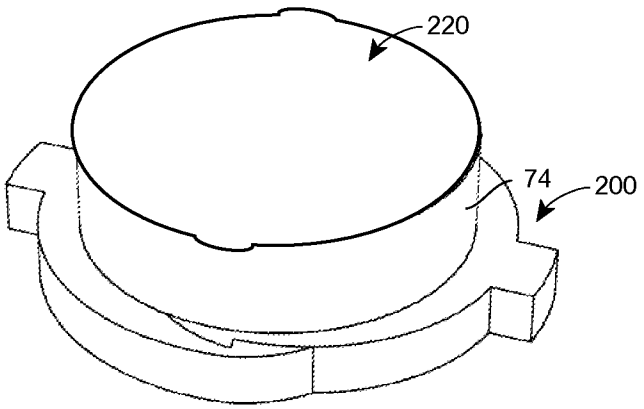
FIG. 4 is a perspective view of the collar of FIG. 3 with a cap attached to the vial, and in particular a crimp ring or seal of the vial.
Figure 3:
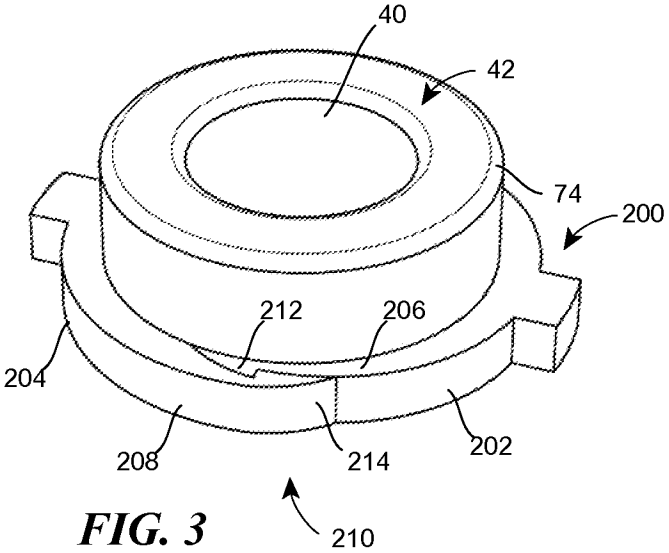
FIG. 3 is a perspective view of another collar for use with the system of FIG. 1.

An embodiment of a collar according to the present disclosure very similar to that illustrated in FIG. 2 is illustrated in FIGS. 3 and 4. The embodiment, designated as 200, also may include first and second C-shaped sections 202, 204 that are joined at opposing end pairs, one set of which is illustrated at 206, 208, by one or more fasteners or pairs of fasteners, again one of which is illustrated at 210. As was the case with the collar 150, the collar 200 may include fasteners 210 in the form of mating hooks 212, 214, which hooks 212, 214 are disposed at the ends 206, 208 of the first and second C-shaped sections 202, 204. The collar 200 is shown as it would be configured in operation against the crimp ring 74 of the vial 42. FIG. 4 illustrates that the collar 200 may be attached to the vial 42 even before a cap, lid or cover 220 is removed from the vial 42 to expose the stopper 40.

Figure 6:
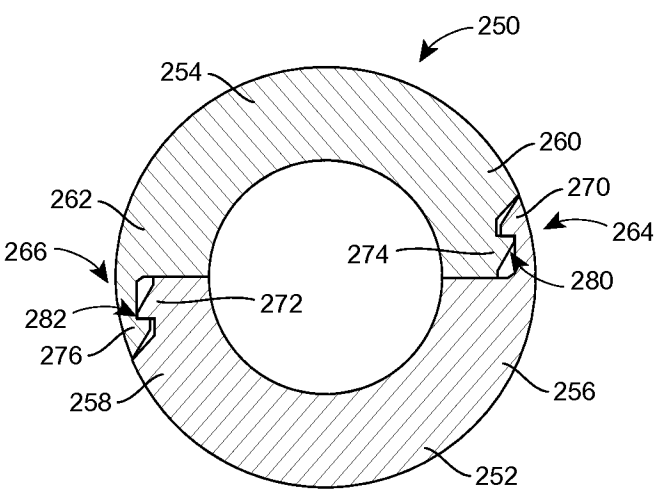
FIG. 6 is a cross-sectional view of the collar of FIG. 5 in a plane parallel to the ends of the collar.
Figure 5:
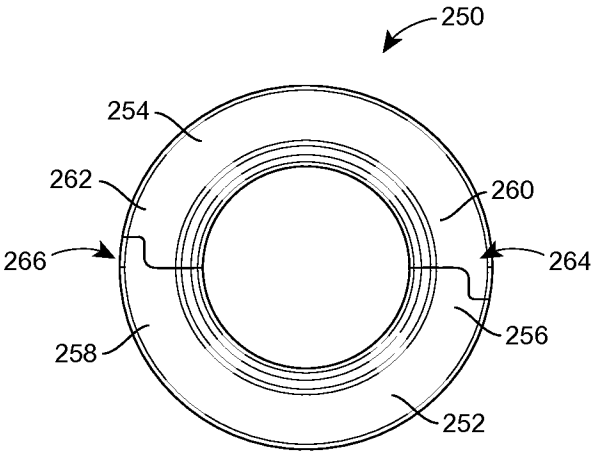
FIG. 5 is a plan view of a further collar for use with the system of FIG. 1.

A further embodiment is illustrated in FIGS. 5-10. The collar, designated generally as 250, may include first and second sections 252, 254, which may be C-shaped as illustrated in FIG. 5. In this regard, the collar 250 is similar to the embodiments illustrated in FIGS. 2-4. Moreover, the sections 252, 254 also may be joined at opposing ends 256, 258, 260, 262 by one or more fasteners or pairs of fasteners 264, 266 as seen in FIGS. 5 and 6. In fact, as illustrated in the cross-sectional view of FIG. 6, each of the pairs of fasteners 264, 266 may include mating hooks 270, 272, 274, 276, wherein one set of the hooks 270, 272 is disposed at the ends 256, 258 of the first C-shaped section 252, and the other set of hooks 274, 276 is disposed at the ends 260, 262 of the second C-shaped section 254.

However, unlike the embodiments illustrated in FIGS. 2-4, the hooks 270, 272 are not both disposed radially inwardly of the hooks 274, 276. Instead, the hook 270 is disposed radially outwardly of the hook 274, while the hook 272 is disposed radially inwardly of the hook 276. Still, opposed surfaces (at 280, 282) of the hooks 270, 272, 274, 276 abut each other to limit or prevent separation of the two C-shaped sections 252, 254 from each other when the collar 250 is disposed about the neck 62 of the vial 42.

Moreover, there are several additional features associated with the sections 252, 254 that are differentiate the embodiment illustrated in FIGS. 5-10 from that illustrated in FIGS. 2-4. These differences may be explained best by discussing one of the C-shaped sections 254 in detail, with the understanding that the other C-shaped 252 is a mating image of the C-shaped section 254 thus discussed. It will be understood that these features could be integrated into the embodiments illustrated in FIGS. 2-4, either individually or in combination.

Figure 9:
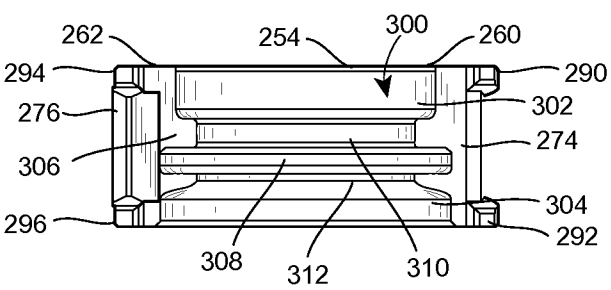
FIG. 9 is a side view of the C-shaped section of FIG. 7.
Figure 10:
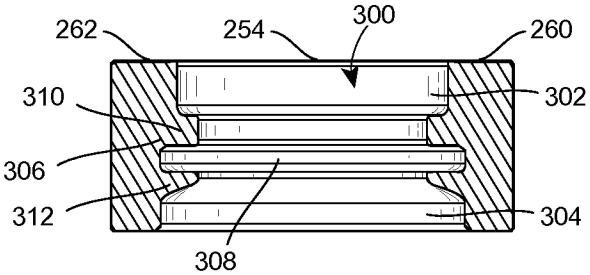
FIG. 10 is another cross-sectional view of the C-shaped section of FIG. 7 taken about line 10-10 in FIG. 7.
Figure 7:
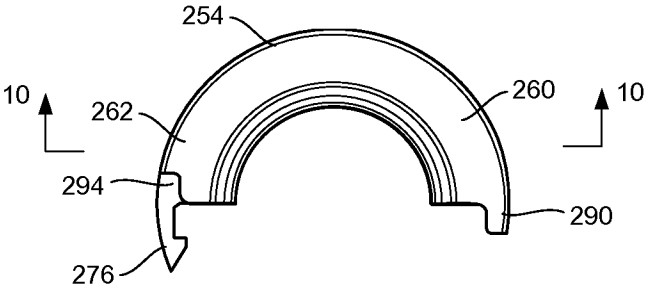
FIG. 7 is a plan view of one of the C-shaped sections of the collar of FIG. 5.
Figure 8:
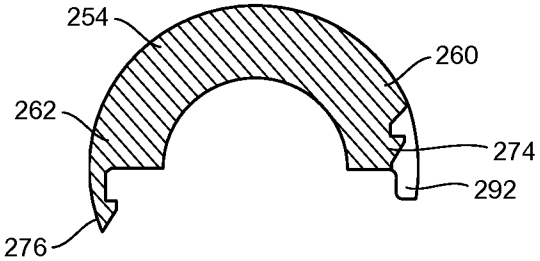
FIG. 8 is a cross-sectional view of the C-shaped section of FIG. 7 in a plane parallel to the ends of the collar.

Turning first to FIGS. 7-9, it will be recognized that each end 260, 262 includes not only a hook 274, 276 that mates with a hook 270, 272 of the other section 252, but each end also includes either a set of tabs 290, 292 or a set of indents or grooves 294, 296. The tabs 290, 292 may be described as being disposed on opposite axial sides of the hook 274, while the indents 294, 296 may be described as being disposed on opposite axial sides of the hook 276. The cooperation of the tabs 290, 292 and indents 294, 296 may be visualized with reference to, for example, FIG. 5. As assembled, the tabs 290, 292 and the indents 294, 296 of the C-shaped section 254 mate with the tabs and grooves of the C-shaped section 252 such that the tabs 290, 292 are disposed in the indents of the C-shaped section 252, while the tabs of the C-shaped section 252 are received within the indents 294, 296.

The tabs 290, 292 and indents 294, 296 may provide certain advantages.

For example, it will be recognized that the two C-shaped sections 252, 254 are not minor images. Instead, the hook 270 of the section 252 depends from the end 256 across the horizontal axis, as does the hook 276 of the section 254, while the hook 272 of the section 252 is formed in the end 258, as is the hook 274 of the section 254. However, the tabs 290, 292 are disposed on the end 260 of the section 254 opposite the hook 270, with a similar arrangement for the tabs of the section 252 opposite the hook 276. As a consequence, when the sections 252, 254 are advanced toward each other to join the sections 252, 254 together by mating the hooks 270, 272 with the hooks 274, 276, the tabs (e.g., the tabs 290, 292) act to guide the hooks (e.g., the hook 270) of the other C-shaped section. As a consequence, the connection of the two C-shaped sections may be simplified and/or facilitated.

Furthermore, because the tabs 290, 292 are received in indents in the C-shaped section 252, and the indents 294, 296 receive the tabs of the C-shaped section 252, the separation of the sections 252, 254 is resisted. That is, the tabs 290, 292 overlap axially with the hook 270, limiting access to the hook 270 from either end of the assembled collar 250. Similarly, the tabs of the C-shaped section 252 overlap axially with the hook 276, limiting access to the hook 276 from either end of the assembled collar 250. While this overlapping obviously resists relative axial movement of the sections 252, 254 relative to each other, it also prevents the hooks 270, 276 that are disposed most radially outward from being acted on by a force applied from the ends to the collar 250 to deflect the hooks 270, 276 radially outward to permit separation of the sections 252, 254. Alternatively, one must remove the tabs 290, 292 if one wishes to apply a force from the ends of the collar 250 to the hook 270, for example, thus providing a visible indication to the user that the collar 250 has been potentially misused.

In addition then to the tabs 290, 292 and indents 294, 296, the collar 250 includes an inner surface 300 that has a unique feature not illustrated in the embodiments of FIGS. 1-4. It will be recognized initially that the inner surface 300 includes a first internal shoulder 302 formed at a first end of the inner surface 300 and that is formed to match, conform to, or receive and end of the crimp ring 74 of the vial 42, and the inner surface includes a second internal shoulder 304 formed at a second end of the inner surface 300 and that is formed to match, conform to, or receive a shoulder of the vial 42. As a consequence, there is a radially inwardly depending central section 306 defined by the shoulders 302, 304 that would be disposed within the neck 62 of the vial 42. In this regard, the collar 250 is similar to the collar 56 illustrated in FIG. 1.

However, unlike the collars 56, 150, and 200 illustrated in FIGS. 1-4, the radially inwardly depending central section 306 of the collar 250 includes an annular groove 308 formed therein (and thus formed in the inner surface 300 as well). As best seen in the cross-section view of FIG. 10, the groove 308 divides the central section 306 of the C-shaped section 254 (and thus the collar 250) into two smaller regions, an upper central region 310 and a lower central region 312, on opposite axial sides of the groove 308. The upper and lower regions 310, 312 are referenced relative to the orientation of the section 254 illustrated in FIG. 10, but this orientation is not intended to limit the section 254 in use or as assembled. Because the collar 250, and in particular the sections 252, 254, comprises a material that has at least limited flexibility, the regions 310, 312 may be deformed during use or as assembled on the vial 42 so as to move axially relative one to the other when the collar 250 is acted upon by the vial 42 with the neck 62 of the vial 42 disposed in the central passage. This motion may also be described as one or both of the upper and lower regions 310, 312 deforming axially into the groove 308, or that the groove 308 is being reduced in cross-sectional area or volume.

In any event, by permitting the deflection of the upper and lower regions 310, 312, the collar 250 permits a snug fit for itself within the neck 62 of the vial 42 over a wide range of tolerances for the neck 62. In this regard, it will be understood that the neck 62 may vary as to the distance between the crimp ring 74 and the opposing shoulder of the vial 42. If there is no mechanism for the collar 250 to adjust automatically for these differences in distance between opposing surfaces of the crimp ring 74 and the shoulder of the vial 42, then the collar 250 may need to be sized to accommodate the minimum possible distance so as to permit the collar 250 to be fitted onto all vials 42 within the range of tolerances. However, if this is done, then in those instances where the distance is greater than the minimum distance, then the collar 250 may move relative to the vial 42 in the neck 62. While this movement may not affect the operation of the system (vial, collar and plate), the user may become concerned by the movement and mistakenly conclude that the system is faulty or inoperative. Consequently, by providing a mechanism (in the form of the regions 310, 314 and associated groove 308) to permit the collar 250 to automatically adjust to differences in the afore-mentioned distance, the incidences of user confusion or mistake may be reduced or eliminated.

Figure 11:
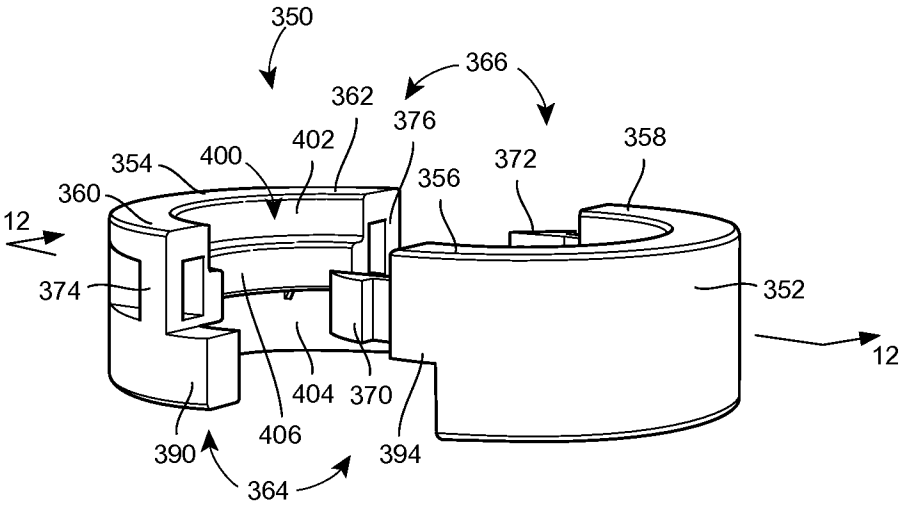
FIG. 11 is an exploded, perspective view of a still further collar for use with the system of FIG. 1.
Figure 12:
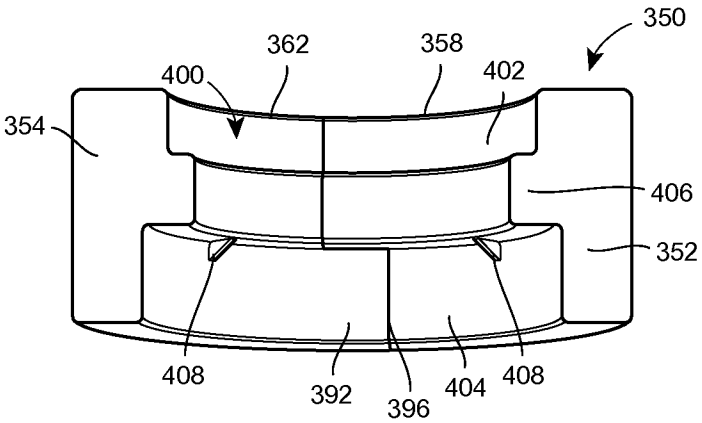
FIG. 12 is a cross-sectional view of the collar of FIG. 11 as assembled, taken about line 12-12 in FIG. 11.
Figure 13:
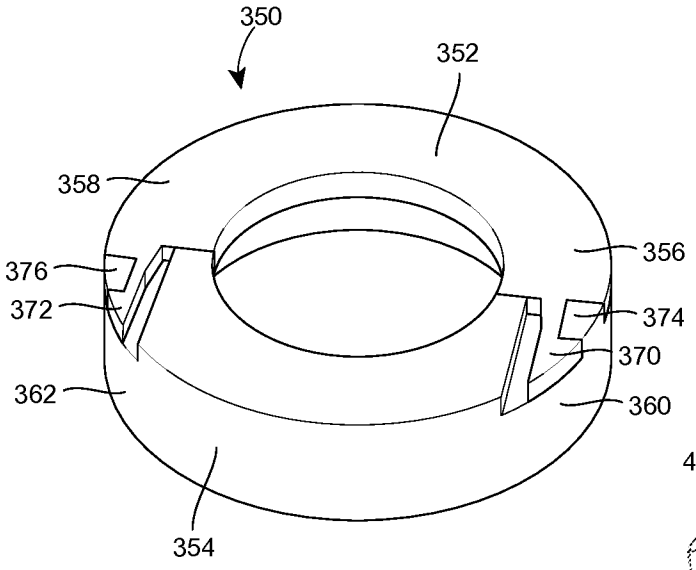
FIG. 13 is another cross-sectional view of the collar of FIG. 12 in a plane parallel to the ends of the collar.

It will be recognized that the collar 250 is simply one embodiment of a variant with tabs/indents and a mechanism for automatically accommodating variation in the neck 62 of the vial 42. A further embodiment in this regard is illustrated in FIGS. 11-13, which shares features in common with that of the embodiment of FIGS. 2-4 and in common with that of the embodiment of FIGS. 5-10, as well as both embodiments.

For example, the collar 350 includes two C-shaped sections 352, 354 joined at opposing ends 356, 358, 360, 362 by one or more fasteners or pairs of fasteners 364, 366, similar to both embodiments mentioned. Similar to the embodiment of FIGS. 2-4, the fasteners 364 include hooks 370, 372 that are disposed radially inwardly on the section 352 at ends 356, 358, and hooks 374, 376 that are disposed radially outwardly of the hooks 370, 372 at the ends 360, 262 (see FIGS. 11 and 13). Abutting surfaces of the hooks 370, 372, 374, 376 may prevent separation of the C-shaped sections 352, 354. In addition, the collar 350 may include tabs 390, 392 that depend from the ends 360, 362 of the C-shaped section 354, and indents 394, 396 that receive the tabs of the C-shaped section 354. See FIGS. 11 and 12. As a consequence, this embodiment is similar to that of the embodiment of FIGS. 5-10 in that the mating surfaces may assist in guiding the two sections 352, 354 as they are assembled.

The collar 350 also has an inner surface 400 includes an internal first shoulder 402 that is shaped to match or conform to the contour of the crimp ring 74 of the vial 42. In addition, the inner surface 400 includes a second internal shoulder 404 that is shaped to match the contour of a shoulder of the vial 42. As a consequence, there is a radially inwardly depending central section 406 that would be disposed to fill the neck 62 of the vial 42. In this regard, the collar 350 is similar to the collar 56 illustrated in FIG. 1.

However, unlike the collar 56 illustrated in FIG. 1 and the collar 250 illustrated in FIGS. 5-10, the radially inwardly depending central section 406 includes one or more fins 408 that bridge a portion of the shoulder 404. As illustrated, these fins 408 are triangular in shape, but it will be recognized that the fins 408 are not limited to such a shape. Moreover, the fins 408 may be deformable or crushable, whether by nature of the material used to form the fins 408, by nature of the thickness of the fins 408, or some other reason. The fins 408 provide an action similar to that of the groove 308 and regions 310, 312: the fins 408 permit a snug fit to be defined relative to the neck 62 of the vial 42 over a range of tolerances for the distance between opposing surfaces of the crimp ring 74 and the shoulder of the vial 42.

Figure 14:
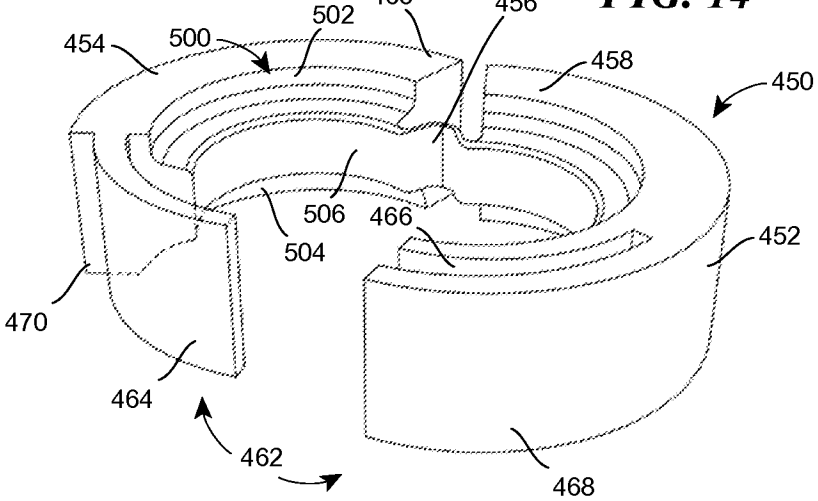
FIG. 14 is a perspective view of yet another collar for use with the system of FIG. 1.

A still further alternative for a collar is illustrated in FIG. 14. According to this embodiment, the collar 450 may include first and second sections 452, 454 that are joined by a hinge 456 (such as a living hinge) at one pair of ends 458, 460 and by one or more fasteners 462 (such as a tongue (464) and groove (466) fastener, as illustrated) at the other pair of ends 468, 470. These sections 452, 454 are joined such that the collar 450 is securely attached to the vial 42 at a neck 62 of the vial 42. Alternatively, while a tongue and groove fastener 462 is illustrated, the mating hook fasteners illustrated in other embodiments may be used instead, as may the tabs and the indents above and/or below such a mating hook fastener.

The collar 450 also includes an inner surface 500 with a first shoulder 502, a second shoulder 504, and a central section 506 that is received within the neck 62 of the vial 42. According to certain embodiments, the central section 506 could include a groove, such as the collar 250, or tabs, such as the collar 350, to facilitate a snug fit within the neck 62 over a range of tolerances. Consequently, a wide range of possibilities may be achieved for this, or any of the other illustrated collars.

Figure 16:
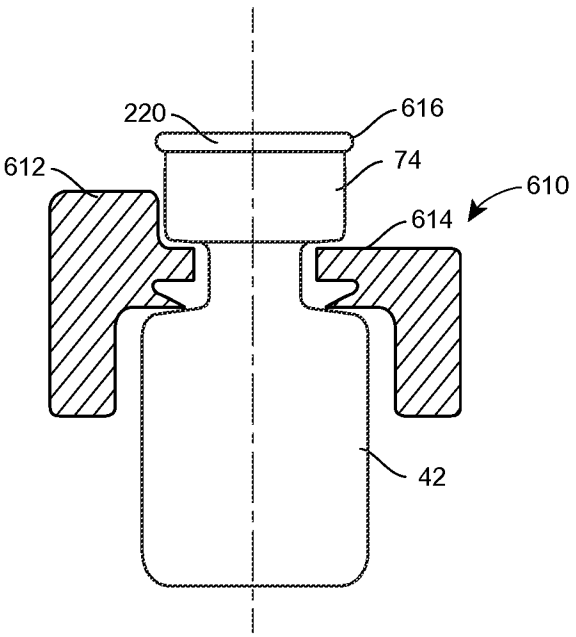
FIG. 16 is a partial cross-sectional view of a still further collar as assembled with a vial having a cap.
Figure 15:
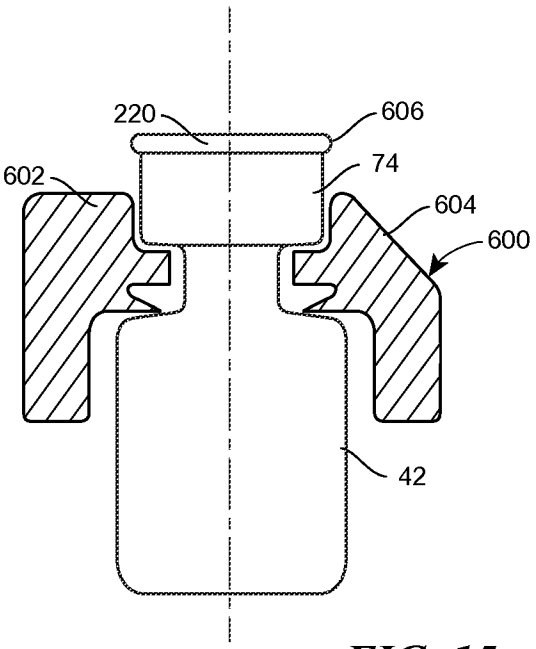
FIG. 15 is a partial cross-sectional view of a further collar as assembled with a vial having a cap.

Still further alternatives for the collar are illustrated in FIGS. 15 and 16. According to these embodiments, the collar is shaped in such a fashion as to facilitate the removal of a cap 220 from the vial 42, in particular from the crimp ring 74. According to both of these variants, an outer surface of the collar is shaped, configured or adapted to facilitate the removal of the cap 220. For example, a collar 600 illustrated in FIG. 15 has an outer surface 602 (which may also be referred to as an upper outer surface, according to the orientation illustrated in FIG. 15) with a sloped edge 604, the sloped edge 604 permitting the user easier and more direct access to an edge 606 of the cap 220. As a further alternative, a collar 610 illustrated in FIG. 16 has an outer surface 612 with a stepped region 614, the stepped region 614 permitting the user easier and more direct access to an edge 616 of the cap 220. It will be further recognized that these features may be used individually (as illustrated) or in combination.

Other advantages not specifically listed herein may also be recognized as well.

We claim:

1. A vial adapter for use with a vial having a neck with a passage in the neck and a rim disposed adjacent the neck, a stopper disposed over the passage in the neck of the vial to control access through the passage into the vial, and a crimp ring disposed about the stopper and the rim to maintain the stopper fixed relative to the vial, the vial adapter comprising:

first and second collar sections each having first and second ends that are joined with the opposing first and second ends of an other one of the first and second collar sections to form a collar having a central passage in which the neck of the vial is disposed, the central passage extending between opposite axial end surfaces of the collar and being narrowest at an inwardly depending axially central section of the collar;

each of the first and second collar sections having a hook formed at each end of each of the first and second collar sections, the hooks of opposing ends of the first and second collar sections joined to each other to join the first and second collar sections together; and the first ends of each of the first and second collar sections having at least one tab depending therefrom and the second ends of each of the first and second collar sections having at least one indent formed therein, the at least one tab of each of the first and second collar sections disposed within the at least one indent of the other one of the first and second collar sections with the hooks of opposing ends of the first and second collar sections joined to each other, the at least one tab of each of the first and second collar sections being located radially outward of an inner portion of the other one of the first and second collar sections, and the at least one tab of each of the first and second collar sections defining an axial end surface of its respective collar section.

2. The vial adapter according to claim 1, wherein each of the first and second collar sections is C-shaped, with the opposing ends of the first and second collar sections joined to form an annular collar.

3. The vial adapter according to claim 1, wherein the hook formed at the second end of each of the first and second collar sections depends from the second end of each of the first and second collar sections, while the hook formed at the first end of each of the first and second collar sections is formed in the first end of each of the first and second collar sections.

4. The vial adapter according to claim 1, wherein the hook formed at the second end of each of the first and second collar sections is disposed radially outwardly of the hook formed at the first end of each of the first and second collar sections.

5. The vial adapter according to claim 1, comprising two tabs depending from the first end of each of the first and second collar sections and two indents formed in the second end of each of the first and second collar sections, the two tabs disposed on opposite axial sides of the hook formed at the first end of each of the first and second collar sections, and the two indents disposed on opposite axial sides of the hook formed in the second end of each of the first and second collar sections, and the two tabs disposed in the two indents with the hooks of opposing ends of the first and second collar sections joined to each other.

6. The vial adapter according to claim 1, wherein the collar has an outer surface with a sloped edge to permit access to a cap attached to the crimp ring.

7. The vial adapter according to claim 1, wherein the collar has an outer surface with a stepped edge to permit access to a cap attached to the crimp ring.

8. A vial adapter for use with a vial having a neck with a passage in the neck and a rim disposed adjacent the neck, a stopper disposed over the passage in the neck of the vial to control access through the passage into the vial, and a crimp ring disposed about the stopper and the rim to maintain the stopper fixed relative to the vial, the vial adapter comprising:

first and second collar sections each having first and second ends that are joined with the opposing first and second ends of an other one of the first and second collar sections to form a collar having an inner surface defining a central passage in which the neck of the vial is disposed, the central passage extending between opposite axial end surfaces of the collar and being narrowest at an inwardly depending axially central section of the collar, the inner surface having a groove formed therein, the groove separating the inwardly depending axially central section of the collar into first and second regions on opposing axial sides of the groove, the first and second regions being deformable axially into the groove when the collar is acted upon by the vial with the neck of the vial disposed in the central passage.

9. The vial adapter according to claim 8, wherein the collar has a first shoulder formed at a first end of the inner surface to receive the crimp ring and a second shoulder formed at a second end of the inner surface to receive a shoulder of the vial, the inwardly depending axially central section of the collar defined between the first and second shoulders, the groove being formed in the inwardly depending axially central section of the collar.

10. The vial adapter according to claim 8, wherein each of the first and second collar sections is C-shaped, with the opposing ends of the first and second collar sections joined to form an annular collar.

11. The vial adapter according to claim 8, wherein the hook formed at the second end of each of the first and second collar sections depends from the second end of each of the first and second collar sections, while the hook formed at the first end of each of the first and second collar sections is formed in the first end of each of the first and second collar sections.

12. The vial adapter according to claim 8, wherein the hook formed at the second end of each of the first and second collar sections is disposed radially outwardly of the hook formed at the first end of each of the first and second collar sections.

13. A vial adapter for use with a vial having a neck with a passage in the neck and a rim disposed adjacent the neck, a stopper disposed over the passage in the neck of the vial to control access through the passage into the vial, and a crimp ring disposed about the stopper and the rim to maintain the stopper fixed relative to the vial, the vial adapter comprising:

first and second sections each having first and second ends that are joined with the opposing first and second ends of an other one of the first and second collar sections to form a collar having an inner surface defining a central passage in which the neck of the vial is disposed, the central passage extending between opposite axial end surfaces of the collar and being narrowest at an inwardly depending axially central section of the collar, each of the first and second collar sections having a hook formed at each end of each of the first and second collar sections, the hooks of opposing ends of the first and second collar sections joined to each other to join the first and second collar sections together, the first ends of each of the first and second collar sections having at least one tab depending therefrom and the second ends of each of the first and second collar sections having at least one indent formed therein, the at least one tab disposed within the at least one indent with the hooks of opposing ends of the first and second collar sections joined to each other, and the inner surface having a groove formed therein, the groove separating the collar into first and second regions, the first and second regions being deformable axially into the groove when the collar is acted upon by the vial with the neck of the vial disposed in the central passage.

14. The vial adapter according to claim 13, wherein each of the collar sections is C-shaped, with the opposing ends of the first and second collar sections joined to form an annular collar.

15. The vial adapter according to claim 13, wherein the hook formed at the second end of each of the first and second collar sections depends from the second end of each of the first and second collar section, while the hook formed at the first end of each of the first and second collar sections is formed in the first end of each of the first and second collar section.

16. The vial adapter according to claim 13, wherein the hook formed at the second end of each of the first and second collar sections is disposed radially outwardly of the hook formed at the first end of each of the first and second collar sections.

17. The vial adapter according to claim 13, comprising two tabs depending from the first ends of the first and second collar sections and two indents formed in the second ends of the first and second collar sections, the two tabs disposed on opposite axial sides of the hook formed at the first ends of the first and second collar sections, and the two indents disposed on opposite axial sides of the hook formed in the second ends of the first and second collar sections, and the two tabs disposed in the two indents with the hooks of opposing ends of the collar first and second sections joined to each other.

18. The vial adapter according to claim 13, wherein the collar has a first shoulder formed at a first end of the inner surface to receive the crimp ring and a second shoulder formed at a second end of the inner surface to receive a shoulder of the vial, the inwardly depending axially central section defined between the first and second shoulders, the groove being formed in the central section.

19. The vial adapter according to claim 13, wherein the at least one tab of each of the first and second collar sections defines an axial end surface of its respective collar section.

20. The vial adapter according to claim 13, wherein the at least one tab of each of the first and second collar sections is disposed radially outward of an inner portion of the other one of the first and second collar sections when the at least one tab is received in the at least one indent of the other one of the first and second collar sections.

* * * * *